US006382072B1

(12) United States Patent
Cipolla

(10) Patent No.: US 6,382,072 B1
(45) Date of Patent: May 7, 2002

(54) SUPPORT AND ALIGNMENT ASSEMBLY

(75) Inventor: Jeffrey L. Cipolla, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/968,397

(22) Filed: Oct. 1, 2001

Related U.S. Application Data

(62) Division of application No. 09/090,222, filed on May 22, 1998, now Pat. No. 6,330,866.

(51) Int. Cl.[7] ..... F41F 3/04

(52) U.S. Cl. ..... 89/1.815; 89/1.816; 89/1.802; 114/238

(58) Field of Search ..... 89/1.816, 1.815; 114/238

(56) References Cited

U.S. PATENT DOCUMENTS 3,048,087 A * 8/1962 Cambell ..... 89/1.802
3,162,088 A * 12/1964 Landstrom ..... 89/45
3,316,808 A * 5/1967 Mais ..... 89/1.815
3,786,715 A * 1/1974 Even ..... 89/1.805
3,857,321 A * 12/1974 Cohen ..... 114/238
3,974,737 A * 8/1976 Georgel et al. ..... 414/343
4,166,406 A * 9/1979 Maughmer ..... 89/1.815
4,307,650 A * 12/1981 Kuesters et al. ..... 89/1.816
4,422,041 A * 12/1983 Lienau ..... 324/174
4,429,616 A * 2/1984 Grosser ..... 89/46
4,489,638 A * 12/1984 Bastian et al. ..... 89/1.815
4,637,292 A * 1/1987 Peterson ..... 89/1.815
4,719,839 A * 1/1988 Smothers et al. ..... 414/609
5,103,713 A * 4/1992 Loving ..... 89/1.816
5,175,600 A * 12/1992 Frank et al. ..... 89/1.816
5,269,214 A * 12/1993 Badura et al. ..... 89/1.816
5,661,254 A * 8/1997 Steuer et al. ..... 102/374

* cited by examiner

*Primary Examiner*—Michael J. Carone
*Assistant Examiner*—Denise J Buckley
(74) *Attorney, Agent, or Firm*—Michael J. McGowan; Prithvi C. Lall; Michael F. Oglo

(57) ABSTRACT

A support and alignment assembly for use on a moving vehicle having a fixed receiver mounted thereon. The assembly comprises a support assembly including (i) a loading tray for supporting a missile, (ii) a storage structure for supporting the loading tray, and (iii) mounts resiliently connecting the storage structure to the vehicle. The missile support and alignment assembly further comprises an alignment assembly including (i) indicator means on the launch tube, (ii) a sensor on the tray for reading a position of the indicator means, the sensor being adapted to send a signal indicative of position of the tray, and thereby a missile on the tray, relative to the indicator means, and thereby the launch tube, (iii) a control device adapted to receive the sensor signals and compute movement of the tray necessary to align the missile with the launch tube, the control device being adapted to send corrective signals, and (iv) alignment motors mounted on the storage structure for receiving the control device signals and for moving the tray relative to the launch tube to bring the missile in the tray into alignment with the launch tube.

12 Claims, 1 Drawing Sheet

SUPPORT AND ALIGNMENT ASSEMBLY

CROSS REFERENCE TO OTHER PATENT APPLICATIONS

This application is a division of patent application Ser. No. 09/090,222, filed May 22, 1998 now U.S. Pat. No. 6,330,866 issued Dec. 18, 2001.

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to launch systems and is directed more particularly to a support and alignment assembly for use on a moving vehicle, such as a submarine, having a fixed receiver.

(2) Description of the Prior Art

Submarines are provided with fixed launch tubes for torpedoes and other missiles and ordnance. The tubes penetrate the pressure hull of the vessel. The launch tubes are arranged in a manner consistent with safety, the architecture of the vessel, and watertight integrity. Proximate the tubes is disposed an arrangement of shelf or frame-like structures for storage of the missiles and/or other ordnance, and a handling system for selecting a weapon, aligning the selected weapon with a selected launch tube, and for feeding the selected weapon into the selected launch tube.

Because of the length-to-diameter ratio of the weapons, and their relative fragility, tolerance on the alignment of weapon and tube during loading is critical. Consequently, current designs for storage, handling and loading systems employ structures securely fixed to the hull, and are aligned with the launch tubes during construction. Such structures do not themselves provide significant shock and acoustic isolation from the hull. Accordingly, considerable effort and expense is devoted to design and analysis of the rigidly fixed structure and to partially isolating substructures to ensure adequate vibration and acoustic isolation. There is, accordingly, a need for a missile support assembly which is resiliently mounted in the submarine so as to "float" relative to the hull.

It is apparent that such a "floating" structure would not maintain a supported missile in alignment with a launch tube at all times. There is accordingly a further need for an alignment assembly which is operative on such a "floating" support to align a missile with a launch tube.

SUMMARY OF THE INVENTION

It is, therefore, an object of the invention to provide a support system for a vehicle having a fixed receiver, the system including a storage structure which is fixed to the vehicle by resilient mounts which permit the storage structure to move relative to the vehicle.

It is a further object of the invention to provide an alignment system for use in conjunction with the aforementioned support system for aligning an object retained by the storage structure with the fixed receiver, such that the object may be pushed into the receiver.

With the above and other objects in view, as will hereinafter appear, a feature of the present invention is the provision of a support assembly for use on a vehicle having a fixed receiver, the assembly comprising a loading tray for supporting an object, a storage structure for supporting the loading tray, and mounts resiliently connecting the storage structure to the vehicle.

In accordance with a further feature of the invention, there is provided a support and alignment assembly for use on a moving vehicle having a fixed receiver mounted thereon, including the assembly comprising, a loading tray for supporting an object receivable by said receiver, a storage structure for supporting said loading tray, mounts resiliently connecting said storage structure to the vehicle, indicator means on the receiver, at least one sensor on said tray for reading a position of said indicator means, said sensor being adapted to send a signal indicative of a position of said tray, and thereby an object on said tray, relative to said indicator means, and thereby the receiver, a control device adapted to receive said sensor signal and compute movement of said tray necessary to align the object with the receiver, said control device being adapted to send corrective signals, and alignment means mounted on said storage structure for receiving said corrective signals and for moving said tray to bring the object in said tray into alignment with the receiver.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
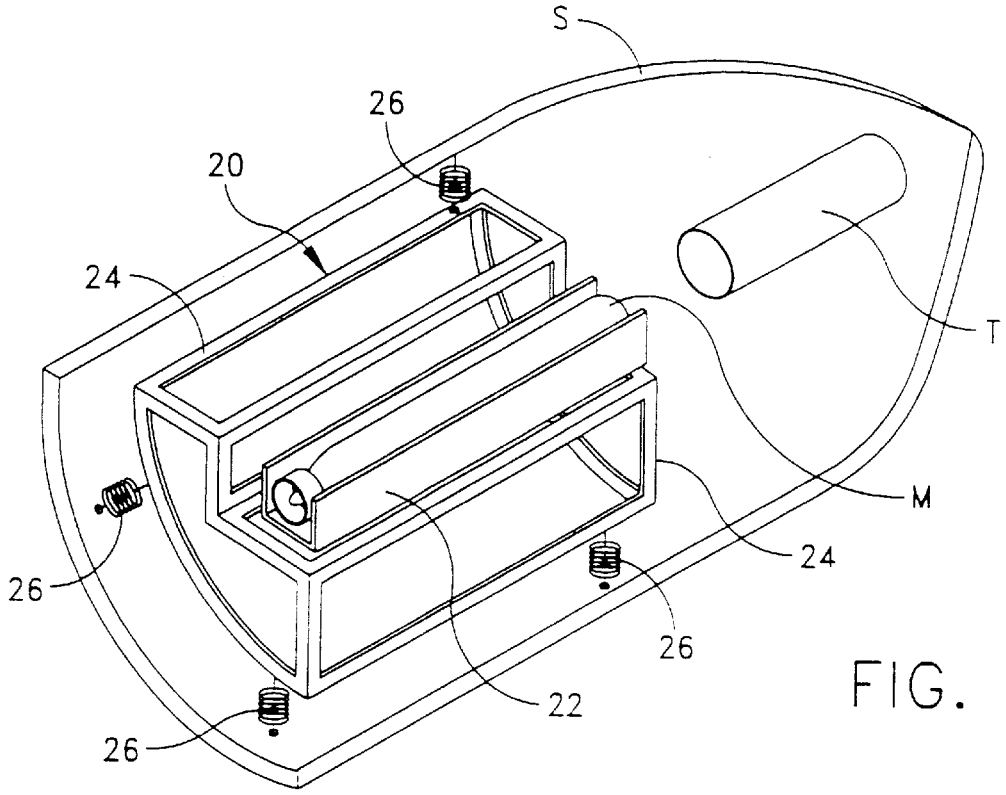
FIG. 1 is a diagrammatic perspective view of one form of a missile support assembly illustrative of an embodiment of the invention.

Referring to FIG. 1, it will be seen that a preferred storage structure assembly 20 includes a loading tray 22 for supporting a missile M for alignment with a launch tube T. The tray 22 is supported by a frame structure 24 which is resiliently connected to a submarine, or other vehicle S, by mounts 26.

Figure 2:
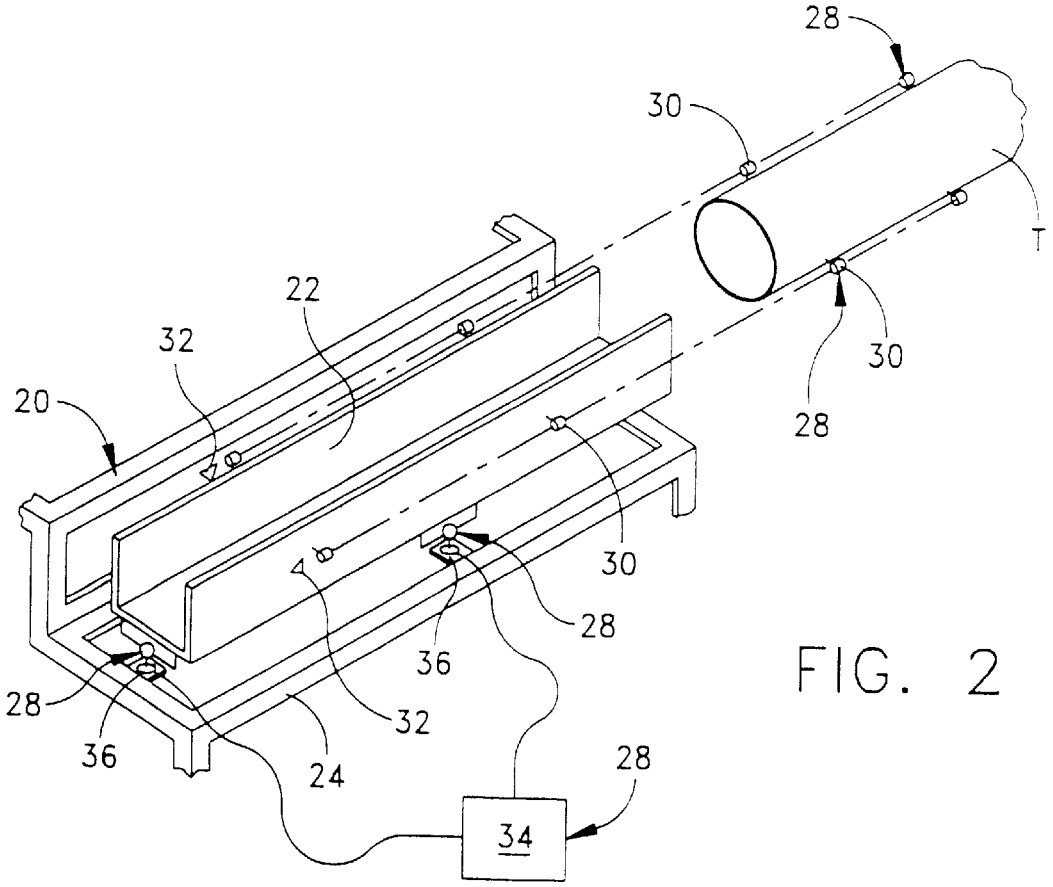
FIG. 2 is similar to FIG. 1, but illustrative of an alignment assembly mounted on the support assembly of FIG. 1.

Referring to FIG. 2, it will be seen that a preferred alignment assembly 28 includes indicator means 30 on launch tube T and tray 22, and sensor means 32 on tray 22. Each sensor means 32 is adapted to read at least one target indicator means 30 and to send a signal indicative of the position of the indicator means relative to the sensor means, and thereby the position of launch tube T relative to missile M.

The indicator means 30 may be in the form of markings or structure, such as fins or pins, or the like, on the launch tube T and, optionally, on tray 22, or active optical or electromagnetic emitters, such as light beam emitters, or the like, on the launch tube and/or tray. The sensor means 32 are adapted to read the markings or target structure, or a beam emitted by a beam emitter.

The alignment assembly 28 further includes a control device 34 which is adapted to receive signals from the sensors 32 and commute or otherwise indicate movement of tray 22 necessary to align missile M with launch tube T. Further included in alignment assembly 28 are alignment motors 36 mounted on frame structure 24 for moving tray 22 to align missile M with launch tube T. The alignment motors 36 may be configured to receive corrective signals directly from control device 34 and in response thereto move the tray as appropriate to align missile m with launch tube T. Alternatively, control device 34 may provide an indication to a human operator who performs final alignment of missile M and tube T by manual control of alignment motors 36.

In operation, when it is desired to initiate a missile launch, the alignment assembly 28 is energized. The sensors 32 signal control device 34 as to the position of tube T, relative to missile M. The control device 34 computes movement of tray 22 required to align missile and tray and sends signals to alignment motors 36 instructing the required movements. The alignment motors 36 operate to move tray 22 to bring the missile M into alignment with the launch tube T. A ram means (not shown), well known in the art, moves the missile axially into the launch tube. The alignment assembly 28 operates continuously from energization to launch tube loading to maintain proper alignment between missile M and launch tube T.

Alternatively, control device 34 provides a continuous indication of the required movements to a human operator. The operator manually controls alignment motors 36 to align missile M and launch tube T.

There is thus provided a missile support assembly which is resiliently mounted in a submarine or other vehicle, and an alignment assembly operative to align a missile resting on the support assembly with a launch tube.

It will be understood that many additional changes in the details, materials, steps and arrangement of parts, which have been herein described and illustrated in order to explain the nature of the invention, may be made by those skilled in the art within the principles and scope of the invention or expressed in the appended claims. For example, while in the above description the use of the assembly described herein is set forth with regard to submarines, and while it is contemplated that the assembly will find substantial use in submarines, it will be apparent that the invention has applications in other marine vehicles, air transport vehicles, and in land-based vehicles, such as railroad cars having launch tubes mounted thereon, or where alignment between separately supported structures is critical and the alignment is subject to movement of the structures relative to one another.

What is claimed is:

1. A support and alignment assembly for use on a moving vehicle having a fixed receiver mounted thereon, the assembly comprising:

a loading tray for supporting an object receivable by said receiver;

a storage structure for supporting said loading tray;

mounts resiliently connecting said storage structure to the vehicle;

indicator means on the receiver, said indicator means comprises markings on the receiver;

at least one sensor on said tray for reading a position of said indicator means, said sensor being adapted to send a signal indicative of a position of said tray, and thereby an object on said tray, relative to said indicator means, and thereby the receiver;

a control device adapted to receive said sensor signal and compute movement of said tray necessary to align the object with the receiver, said control device being adapted to send corrective signals; and alignment means mounted on said storage structure for receiving said corrective signals and for moving said tray to bring the object in said tray into alignment with the receiver.

2. The support and alignment assembly in accordance with claim 1 wherein said loading tray is movable on said storage structure to align the object with the receiver.

3. The support and alignment assembly in accordance with claim 1 wherein said indicator means comprises electromagnetic emitters.

4. The support and alignment assembly in accordance with claim 1 wherein said indicator means further comprises markings on said loader tray.

5. The support and alignment assembly in accordance with claim 3 wherein said indicator means further comprises electromagnetic emitters on said loading tray.

6. The support and alignment assembly in accordance with claim 1 wherein said at least one sensor is an electromagnetic sensor.

7. The support and alignment assembly in accordance with claim 3 wherein said at least one sensor is an electromagnetic sensor.

8. The support and alignment assembly in accordance with claim 1 wherein said indicator means comprises a portion of the receiver and said sensor comprises an electromagnetic sensor adapted to read a position of said portion.

9. The support and alignment assembly in accordance with claim 1 wherein said alignment means comprises motor means for moving the object into axial alignment with the receiver in response to said corrective signals of said control device.

10. The support and alignment assembly in accordance with claim 1 wherein said vehicle comprises a submarine.

11. The support and alignment assembly in accordance with claim 10 wherein:

said receiver comprises a missile launch tube; and said object comprises a missile.

12. The support and alignment assembly in accordance with claim 11 wherein:

the missile comprises a torpedo; and the missile launch tube comprises a torpedo tube.

* * * * *